United States Patent [19]

Rataj et al.

[11] 4,123,114

[45] Oct. 31, 1978

[54] ARRANGEMENT FOR THE PNEUMATIC REMOVAL OF BULK PARTICULATE MATERIAL FROM THE FLOOR OF A STORAGE PLACE

[75] Inventors: Stanislav Rataj, Rudolfov; Karel Krch, Plana nad Luznici; Josef Pilousek, Lhota pod Horami; Jaroslav Blazek, Kosice u Tabora; Hynek Vitek, Podoli u Tabora; Ladislav Macek, Tabor, all of Czechoslovakia

[73] Assignee: Zemedelsky nakupni a zasobovaci podnik narodni podnik, Ceske Budejovice, Czechoslovakia

[21] Appl. No.: 775,783

[22] Filed: Mar. 9, 1977

[51] Int. Cl.[2] ..... B65G 53/40

[52] U.S. Cl. ..... 302/53; 302/31

[58] Field of Search ..... 302/29, 31, 51, 53, 302/57, 52; 214/17 D; 198/616

[56] References Cited

U.S. PATENT DOCUMENTS

| | | | |
|---|---|---|---|
| 2,678,237 | 5/1954 | Allander et al. | 302/31 |
| 3,056,632 | 10/1962 | Isler | 302/31 |

*Primary Examiner*—Evon C. Blunk
*Assistant Examiner*—James L. Rowland

[57] ABSTRACT

An arrangement for the pneumatic removal of bulk particulate material from the floor of a storage place is described. Pressure air conveys the stored material in a floating condition toward one end of the storage place, where it is collected and forwarded by a further material-conveying means. The arrangement not only discharges the particulate material from the storage place, but simultaneously carries out the aeration of the stored material, by hot or cold air as desired.

3 Claims, 3 Drawing Figures

ARRANGEMENT FOR THE PNEUMATIC REMOVAL OF BULK PARTICULATE MATERIAL FROM THE FLOOR OF A STORAGE PLACE

BACKGROUND OF THE INVENTION

This invention relates to an arrangement for the pneumatic removal of bulk particulate material, for instance, grain and the like, from the floor of a storage place by directed streams of pressure air. The arrangement of the invention also permits an aeration of the stored material by cold or warmed air, as desired.

Known arrangements for the removal of bulk particulate material from storage places employ either mechanical or pneumatic transport systems.

Known mechanical systems for the emptying of the floor of storage places employ transport systems such as band, chain, worm, and similar conveyors. Such conveyors are usually mounted on or above the level of the floor of the storage place, or in some instances they are portable. Such mechanical material transporting means usually are employed in combination with different collecting means such as mechanical shovels, submerged screw conveyors, and the like. In some cases the correcting of the material is carried out manually by shovels. This method of removing bulk particulate material from floor storage places is most widely used; however, it requires a number of mechanical material transporting means with their respective driving units, and consequently involves substantial expenses for the purchase of the equipment, for maintenance, for the distribution of electricity to the driving means, and the like. With such arrangements there are frequent failures of the mechanical units, and thus substantial lost time, particularly in view of the large number of mobile components in the arrangement. Further, one or more attendants are required to operate the mechanical collection means or to collect the material manually, such attendants being required to perform their work in a dusty, unhealthful atmosphere. If the bulk particulate material, for instance, grain, is to be aerated by cold or warm air, an additional, special aeration device must be provided.

When the bulk particulate material is removed pneumatically, the pneumatic removal system may be either portable or fixed. Portable arrangements for this purpose use only the suction effect of air which is generated by blowers or ventilators, the removed material being conveyed from the storage place by conduits. This method of emptying storage places requires the presence of an attendant inside the storage place, such as a silo or other storage building, the attendant manually controlling the suction nozzle connected to the material-conveying conduit. In the case of portable arrangements, the attendant controls the travel of the discharge mechanism along the floor of the storage place. This method of material removal does not permit the aeration of bulk particulate material.

Fixedly installed pneumatic devices for discharging bulk particulate material employ the pressure effect of air. In such arrangements, there is usually provided a main channel located along the longitudinal axis of the storage place, where distribution closures for air, or a chain or band conveyor, and further closures for the bulk material are provided. Emptying channels, generally disposed at the level of the floor of the storage place, are connected to the main channel, such emptying channels serving to direct the pressure air against the stored material so as to cause the material to travel toward the main channel.

The drawback of this method of discharging bulk particulate material is the limitation of a planar emptying of the bulk material from the storage space to a distance of 10 meters from the main channel. Furthermore, construction of the main channel with distributing closing means controllable by one or more attendants is intricate and expensive. The further drawback of such arrangement is that the main channel occupies a substantial part of the space within the storage place, thereby reducing its storage capacity. Also, the emptying process has to be interrupted if any adjustments of the closing means in the main channel are required. The closing means have to be controlled by an attendant who must enter the main channel, the space within which is rather limited. Any repairs of the mechanical material transporting means, for instance the chain or band conveyor, also have to be made inside this channel. This method of bulk particulate material discharge involves fairly high investment costs, and makes it practically impossible advantageously to use the floor storage place for other purposes, such as, for example, material in sacks or on pallets.

SUMMARY OF THE INVENTION

The invention has among its objects the elimination or at least the substantial reduction of the prior systems for the pneumatic emptying of bulk particulate material from floor and similar storage places.

In accordance with the invention, a plurality of material-floating and forwarding channels are disposed in the floor of the storage place, such channels being spaced from each other so as effectively to cover the floor in their discharging action. One end of each of the material-floating and forwarding channels is connected to a main air channel through an air closure device, the main air channel being provided with pressure air by a blower connected thereto. The material-floating and forwarding channels are provided in their top portions with pressure air baffling or directing fins, the gaps provided by the baffling fins being directed to the ends of the material floating channels remote from the main air channel. Openings are provided in the wall of the storage place remote from or opposite to the main air channel, there being selectively controllable gates for such openings. A further conveyor, such as a mechanical conveyor, receives the material passing through the openings of the wall of the storage place and forwards it as required. A further distribution channel is preferably provided along the wall of the storage place above such further conveyor, the further distribution channel being connected through further air closures and conduits to the ends of the individual floating channels which lie remote from the main air channel.

The arrangement according to the invention is simple in construction and relatively inexpensive; it is reliable in operation, both in material-emptying and in material-aeration, requires minimum maintenance, and does not require the constant presence of an attendant inside the storage place during its operation. Thus the arrangement is capable of constant material-emptying operation, the adjustment of the air closures being preferably performed from outside the storage space during the operation of the arrangement. As a result, the attendants are not exposed to the deleterious effects of the dusty atmosphere within the storage space, and do not need to enter any confined spaces. The arrangement eliminates hard manual labor, and a greater efficiency of use of the storage space is achieved by the reduction of the required elements of the arrangement which are built in inside the storage space. All movable components of the arrangement are permanently accessible for repair and maintenance, and a floor storage place provided with the arrangement of the invention can also be used for the storage of other materials, for instance, of goods in sacks or on pallets. The pressure air employed for the emptying of material in the arrangement of the invention is effective over larger distances with a high emptying efficiency than in the above-described prior pneumatic emptying devices.

DESCRIPTION OF THE DRAWINGS

An exemplary embodiment of an arrangement in accordance with the invention is shown in the attached drawings, wherein.

DESCRIPTION OF PREFERRED EMBODIMENT

Figure 3:
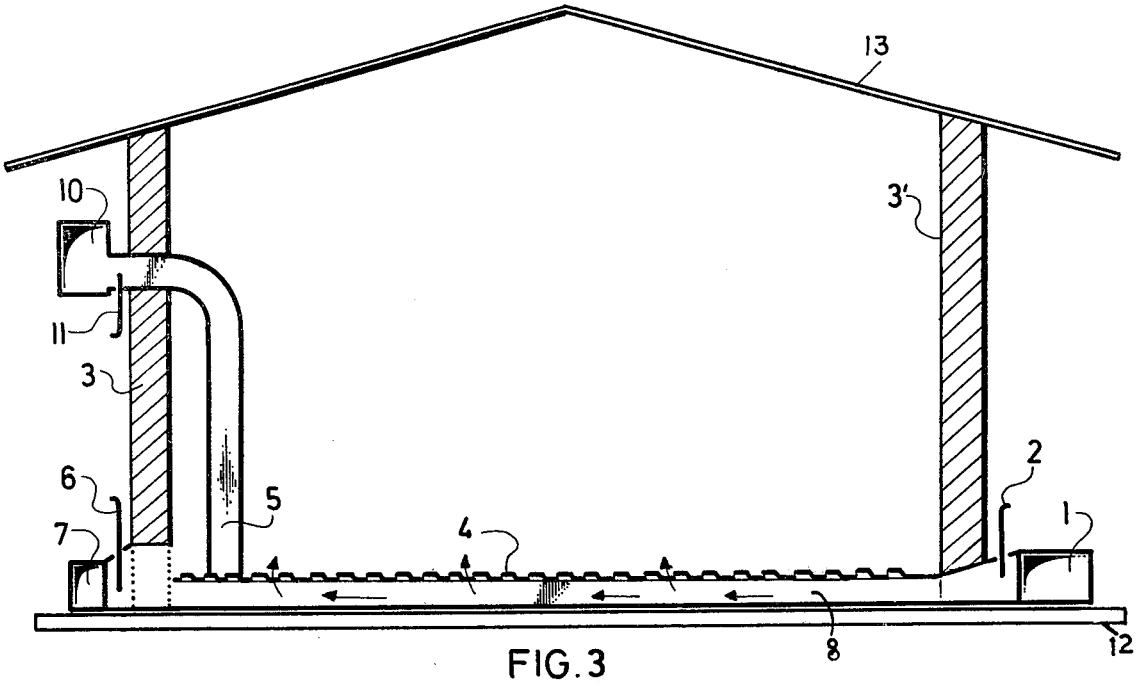
FIG. 3 is a further sectional side view, the section being taken along a plane indicated by the line B—B in FIG. 1.

The storage place to be emptied of particulate material which is shown in the drawings is in the form of an elongated building having spaced parallel side walls 3, 3', a floor 12, and a roof 13. A main air channel 1 is disposed along the outside of the wall 3 adjacent the floor 12, one end of channel 1 being closed and the other end thereof being connected to an air blower (not shown). A number of uniformly spaced material-floating and conveying channels 8 extending transversely of the longitudinal axis of the storage space are provided, two such channels 8 being shown in FIG. 1, the right-hand ends of the channels 8 in FIG. 1 being connected to the main air channel 1, and the other end of the channels 8, remote from the air channel 1, extending to the opposite wall 3'. Openings through the base of wall 3' connect such latter ends of the channels 8 to a mechanical conveyor 7 which extends along the outside of the wall 3'. Communication between the left-hand ends of channels 8 (FIG. 1) and the conveyor 7 is controlled by gates 6, such gates being individually controllable.

Figure 2:
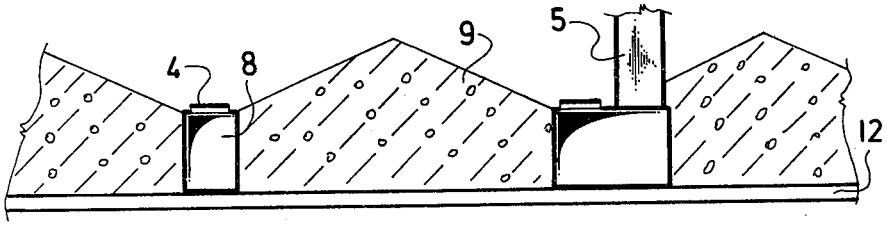
FIG. 2 is a sectional side view of the arrangement with the section being taken along planes indicated by the broken line A—A in FIG. 1.

As shown in FIG. 2, the material-floating channels 8 which are of rectangular cross-section, are supported upon the floor 12, the material-supporting structure 9 between, successive channels 8 sloping downwardly in opposite directions toward the respective material-floating and conveying channels so that the material supported by means 8 tends naturally to flow downwardly toward the respective channels 8.

The upper part of each of the channels 8 is provided with air-directing fins 4 which are bent up out of the sheet metal constituting the top of the channel, the left-hand end of each fin being vertically spaced from the right-hand end of the next adjacent fin to the left so as to present a gap which is directed toward the gate 6 for that particular channel 8. The flow of air through each of the channels 8 and outwardly through the air-directing gaps presented by the fins 4 is depicted by arrows in FIG. 3.

Figure 1:
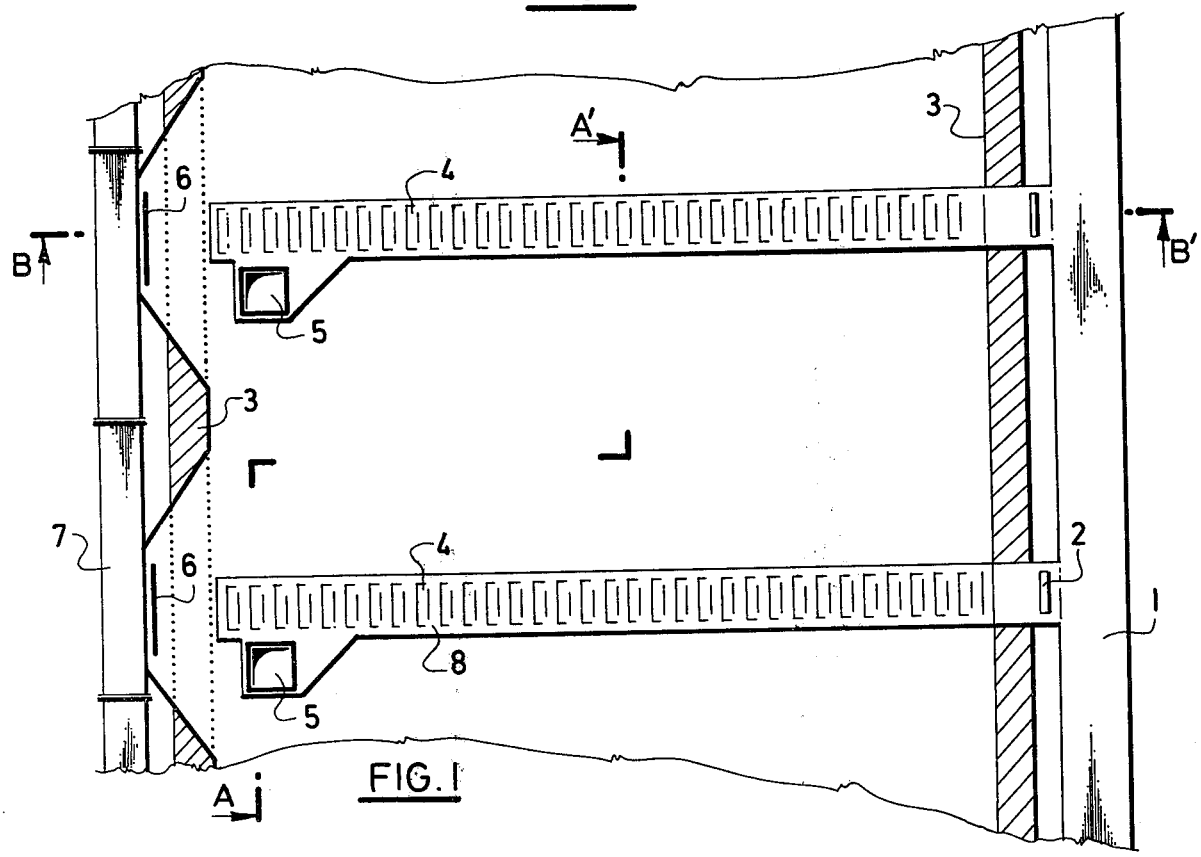
FIG. 1 is a top view of a material-emptying arrangement situated in a floor storage place.

The air inlet for each of the channels 8 from the main air channel 1 is provided with a controllable closure means 2 as indicated in FIGS. 1 and 3.

The channels 8 are preferably provided at their left-hand ends (FIGS. 1 and 3) with generally vertically extending further conduits 5 which are connected to a further air channel 10, extending along the outside of wall 3', the flow of air from channel 10 into the conduits 5 being controlled by individual adjustable closure means 11.

The material-floating and forwarding channels 8 can be of rectangular, square, or trapezoidal cross-section. As shown in FIG. 2, the channels 8 are disposed below the lowermost layer of stored particulate material in the storage place. The emptying of the material from such storage place is accomplished by opening gates 6 for the material, so that the material spontaneously falls into the mechanical conveying means 7. Means 7 may, for example, be any one of a number of common conveyors such as band conveyors, chain or worm conveyors. Air under pressure from the main air channel 1 enters the material floating channels 8 after opening the respective air closure devices 2. Air then proceeds along the floating channels 8 and leaves such channels by way of paths of the least resistance, i.e., at the start of the emptying operation at the end of the channels nearest the gates 6. In the course of leaving the channels 8, the pressure air is directed by the gaps presented by the fins 4 in the direction toward the respective gates 6.

Upon leaving the gaps presented by the fins 4, the pressure air causes a floating and thus a subsequent removal of the stored particulate material from the lower layer thereof and its conveying on an air cushion in the direction of the axis of the material-floating channel 8 toward the respective gate 6 and thus to the mechanical conveyor means 7. The removal of the material proceeds progressively across the width of the storage space until the material is removed from adjacent the right-hand wall 3 of the storage space.

In order to provide a uniform air pressure at all places in the material-floating channels 8, it is advantageous to use another blower, which supplies air under pressure into the material-floating channels 8 via a distribution channel 10, further air closures 11, and the above-described conduits 5. The reverse inclination of the upper surface of the material-supporting structure 9 between successive channels 8 allows the complete emptying of the floor of the storage place. The material-floating channels 8 are preferably disposed parallel with the shorter axis of the storage space, and are connected at one or both ends to the main air channel 1 or to a distribution channel 10 by means of air closures such as closures 2 and 11, respectively, by means of which the emptying of the storage place is controlled. The output of the arrangement during the emptying operation can also be controlled by the gates 6.

The arrangement can also be employed to provide an aeration of the stored material by cold or hot air during the storing of the material, thus influencing the storage capability of the material. In the course of such aeration, the gates 6 remain closed and the air after leaving the channels 8 passes upwardly through the stored particulate material in the storage place.

In the foregoing, an illustrative embodiment of the invention has been described. Many variations and modifications will now occur to those skilled in the art. It is accordingly desired that the scope of the appended claims not be limited to the specific disclosure herein contained.

What is claimed is:

1. An arrangement for the pneumatic removal of air-floatable bulk particulate material from the floor of a multiple-sided walled storage place having first and second opposite walls spaced from each other, comprising a main air channel along said first side wall of the storage place, a source of pressure air connected to said main air channel, a number of material-floating and conveying channels extending substantially from the first to the second wall and having the ends thereof at the first wall connected to said main channel, the material-floating and conveying channels being distributed over the area of the floor of the storage place, air closures disposed between the main channel and the first ends of the individual material-floating channels adjacent the main channel, the material-floating channels being provided in the parts thereof engaging the material in a storage place with air-directing fins, the fins providing air discharging gaps directed toward the end of the material-floating channels remote from the main channel, gates for the bulk material provided in the wall of the storage place remote from the main air channel, conveyor means outwardly of the gates adapted to receive and forward material delivered thereto through the gates, an additional distribution channel for pressure air along the second side wall of the storage place, a source of pressure air for said additional distribution channel, and air closures and conduits connecting the additional distribution channel with the second ends of the individual material-floating and conveying channels.

2. Arrangement as in claim 1, wherein the material-floating and conveying channels are disposed generally beneath the material-supporting upper surface of the floor, and the fins on the channels are disposed on the upper portions of the material-floating and conveying channels.

3. Arrangement as in claim 2, wherein the floor in the span thereof between successive material-floating and conveying channels slopes downwardly in opposite directions toward the respective material-floating and conveying channels from locations intermediate the span.

* * * * *